US007128447B2

(12) United States Patent
Chen

(10) Patent No.: US 7,128,447 B2
(45) Date of Patent: Oct. 31, 2006

(54) FASTENING DEVICE

(75) Inventor: Chun-Yuan Chen, Lujhu Township, Kaohsiung County (TW)

(73) Assignee: AU Optronics Corporation, Hsinchu (TW)

( * ) Notice: Subject to any disclaimer, the term of this patent is extended or adjusted under 35 U.S.C. 154(b) by 74 days.

(21) Appl. No.: 10/983,232

(22) Filed: Nov. 8, 2004

(65) Prior Publication Data

US 2006/0007687 A1 Jan. 12, 2006

(30) Foreign Application Priority Data

Jul. 7, 2004 (TW) ..... 93120380 A

(51) Int. Cl.
*F21V 29/00* (2006.01)

(52) U.S. Cl. ..... 362/373; 362/294; 362/218

(58) Field of Classification Search ..... 362/294, 362/373, 345, 218
See application file for complete search history.

(56) References Cited

U.S. PATENT DOCUMENTS 3,832,540 A 8/1974 Roth ..... 362/217
6,441,874 B1 * 8/2002 Saito et al. ..... 349/70
6,693,682 B1 * 2/2004 Fujishiro et al. ..... 349/65
6,749,462 B1 6/2004 Sun et al.
2002/0063514 A1 5/2002 Oishi et al.
2002/0067122 A1 6/2002 Eom
2002/0070600 A1 6/2002 Ro et al.
2003/0043569 A1 3/2003 Mori et al.
2003/0071933 A1 4/2003 Ohta et al.
2003/0075253 A1 4/2003 Serra et al.
2003/0132711 A1 7/2003 Yoo et al.
2003/0137237 A1 7/2003 Kim et al.
2005/0099806 A1 * 5/2005 Tsai ..... 362/218

* cited by examiner

*Primary Examiner*—Ali Alavi
(74) *Attorney, Agent, or Firm*—Raymond J. Ho; David B. Dort; Genus Law Group PLLC

(57) ABSTRACT

A fastening device is provided for cooling the light source in a backlight module. The fastening device includes a frame for clipping the edge of a light source and a cooling unit disposed between the frame and the light source. The cooling unit is not only utilized for cooling, it also utilized for preventing the oscillation that affects the emitting efficiency and the operating stability of the light source.

5 Claims, 5 Drawing Sheets

FASTENING DEVICE

BACKGROUND OF THE INVENTION

1. Field of the Invention

The present invention relates to a fastening device, and more particularly to a fastening device including a cooling unit made of an elastic material with a high thermal conductivity, wherein the fastening device is used for a backlight module.

2. Description of Related Art

The development of the digital technology affects the work and the life of people living in the 21 century. One kind of digital technology instrument, i.e. liquid crystal display equipment, is popularly applied to the daily life. The liquid-crystal panels of the liquid crystal display industry can be applied to notebook computers, liquid-crystal monitors, portable consumable image products, music products, cell phones and liquid-crystal televisions.

A backlight module of an LCD device is a common structure for providing the uniform light. The backlight module has many advantages of, e.g. a stable emitting efficiency and a long operational life. However, most of the light sources of the backlight modules are made of glass and produce a lot of heat while the light source is operated. The operated light source has to be cooled for maintaining the stability of the emitting efficiency and the operational life.

Referring to FIG. 1A, which illustrates a vertical view of a conventional bottom-lighting LCD device 10. A light source 101 and other optical elements (not shown) such as a diffusing plate, a reflecting plate, and a polarizing plate are assembled within the case 111 of the LCD device 10. And the edge of the light source 101 is clipped by an upper frame 103 (or is called "front frame") and a lower frame 105 (or is called "back frame") to ensure that the light will emit along a designed direction, such as the direction indicated by the arrows in FIG. 1A. Besides, in order to cool the heat produced by the light source 101, a cavity 107 are formed to allow the air circulating through the cavity 107.

However, cooling the light source 101 by providing the cavity 107 between the upper frame 103, the lower frame 105 and the light source 101 is not effectively. Furthermore, the quality of the LCD device is affected because the dust may drop in the cavity 107 and interfere the light emitting from the light source 101.

Another conventional LCD device is shown in FIG. 1B. Elastic element such as resin (not shown) or a slice of rubber 109 is provided and stuffed between the frame 103 and the light source 101 to ensure that the light will emit along a designed direction, such as the direction indicated by the arrows in FIG. 1B and to absorb the oscillation arising from external force.

However, the rubber 109 does not have a high thermal conductivity. The quality and the operational life of the light source 101 is decreased because there is not enough space for cooling.

Thus it is necessary to develop a fastening device to overcome the disadvantage of the prior art for radiating the heat from the light source more effectively, and preventing the oscillation that affects the operating stability of the light source, the quality of the light, and the operational life of the light source.

SUMMARY OF THE INVENTION

It is therefore an object of the present invention to radiate the heat produced by a light source more effectively and receives the oscillation more effectively for increasing the operational life and the operating stability of the light source.

In accordance with one embodiment of the present invention, it is provided a fastening device for cooling the light source. The fastening device according to the present invention includes a frame for clipping the edge of a light source and a cooling rubber disposed between the frame and the light source.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

These preferred embodiments of the present invention are now described in detail. Nevertheless, it should be recognized that the present invention can be practiced in a wide range of other embodiments besides those explicitly described, and the scope of the present invention is expressly not limited except as specified in the accompanying claims.

Figure 1A:
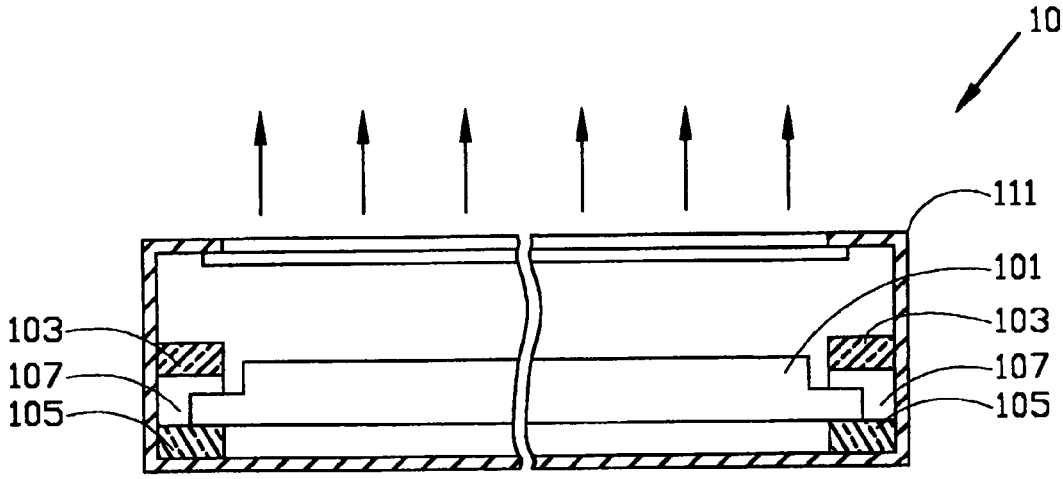
FIG.1A(Prior Art)
FIG. 1A and FIG. 1B illustrate schematic diagrams of conventional fastening devices in an LCD device.
Figure 1B:
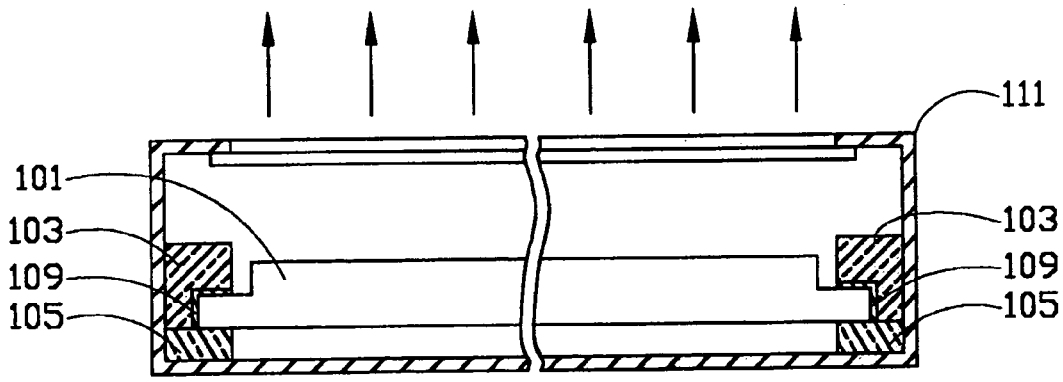
FIG.1B(Prior Art)
Figure 2A:
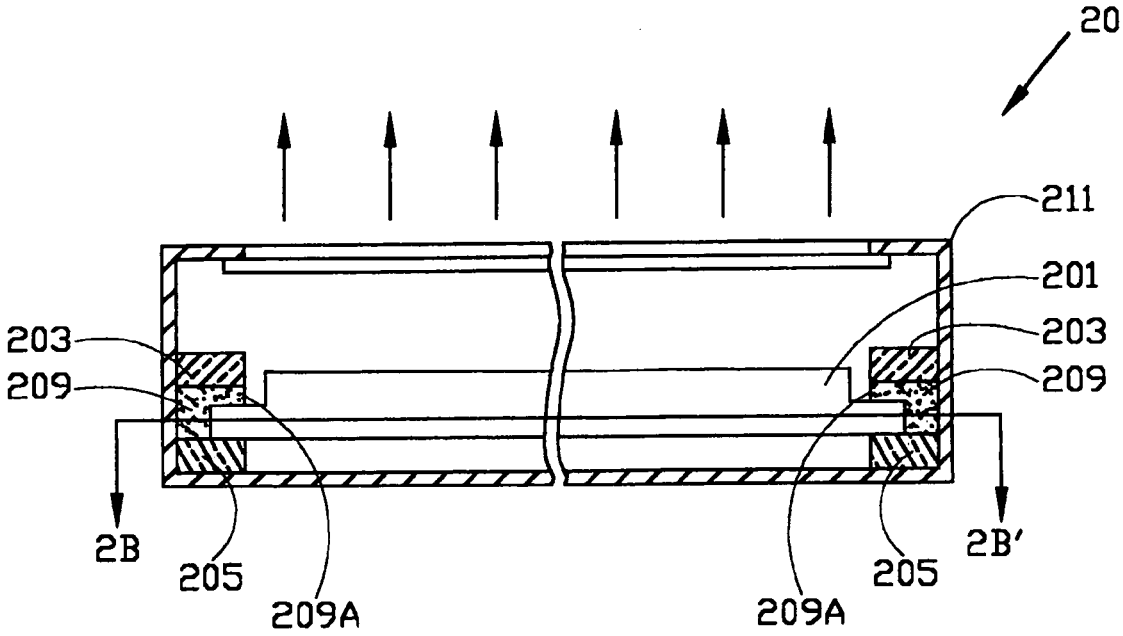
FIG. 2A and FIG. 2B illustrate schematic diagrams of a fastening device according to the first embodiment of the present invention.

Referring to FIG. 2A, the first embodiment of the present invention is directed to a fastening device applied to an LCD device 20. A light source 201 and other optical elements (not shown) such as a diffusing plate, a reflecting plate, and a polarizing plate are assembled within the case 211 of the LCD device 20. Edge of the light source 201 could be clipped by the fastening device, which is composed of an upper frame 203 (or is called "front frame") and a lower frame 205 (or is called "back frame"), and a cooling unit 209. Besides, in order to cool the heat produced by the light source 101, the cooling unit 209 is disposed between the frames 203 and 205, and the light source 201. Hence, the light source 201 could be fastened by the cooperation of cooling unit 209 and frames 203 and 205, and uniform light will emit along a designed direction, such as the direction indicated by the arrows in FIG. 2A. Furthermore, the cooling unit 209 has a reflecting surface 209A to increase the lighting efficiency. The reflecting surface 209A could be arranged substantially facing toward the light source 201 by coating the reflecting material on the portion of the surface of the cooling unit 209.

The cooling unit 209 held by the frames 203 and 205 is an elastic material with a high thermal conductivity, wherein the thermal conductivity coefficient of the cooling unit 209 is higher than 1.0 W/mK. For example, LANJO SILICONE SA600 STOCK, produced by Lanjo Rubber Enterprises Co., Ltd., Taipei, Taiwan, is one kind of the elastic material suitable for the embodiment of the present invention. Hence, when a light is emitting from the light source 101, heat is also produced. And the cooling unit 209 could be utilized to help with heat exchanger and cool the light source 201. Furthermore, because the cooling unit 209 is an elastic material, the cooling unit 209 could protect the light source 201 from the oscillation caused in many different kinds of external force, e.g. the drop experiment, the transportation, . . . etc.

The present fastening device could prevent dust from dropping into the cavities of the conventional frame and increase the lighting efficiency of the light source 201. The cooling unit 209 not only protects the light source 201 from the oscillation but also cools the light source 201 while increasing the operational life and the operating stability of the light source 201.

Figure 2B:
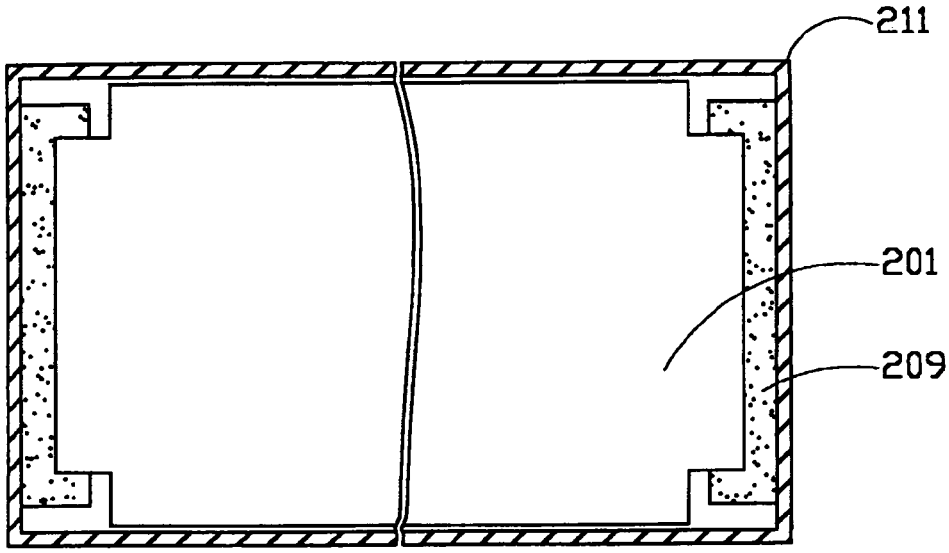

FIG. 2B is a sectional view of a fastening device of this embodiment along line 2B–2B' of FIG. 2A. It's observed that the cooling unit 209 fastens the edge of light source 201.

Figure 3A:
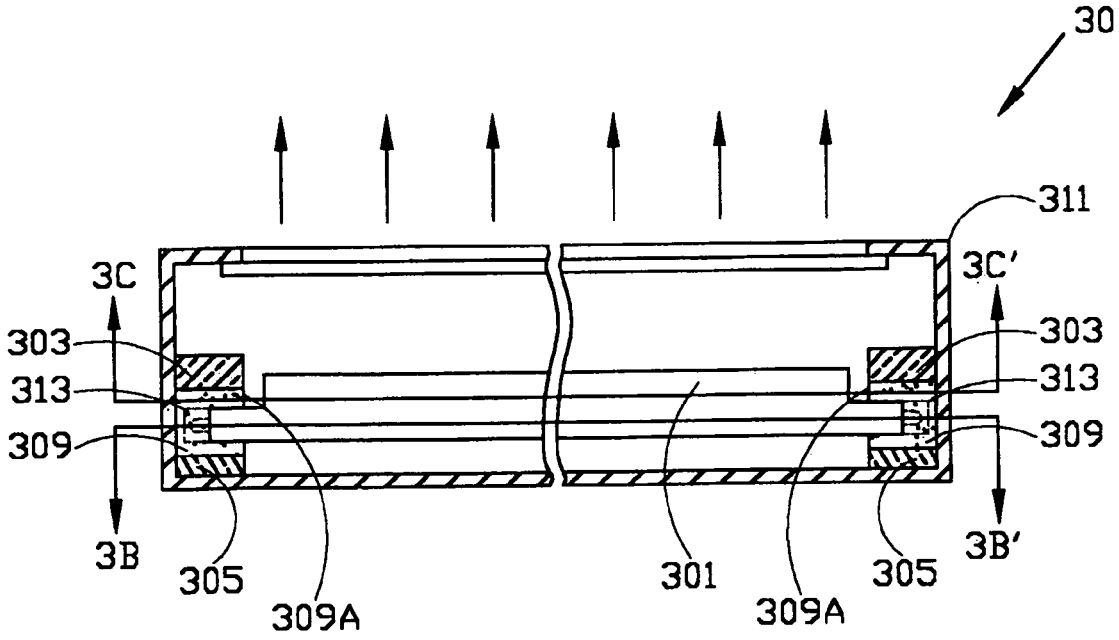
FIG. 3A to FIG. 3C illustrate schematic diagrams of a fastening device according to the second embodiment of the present invention.
Figure 3B:
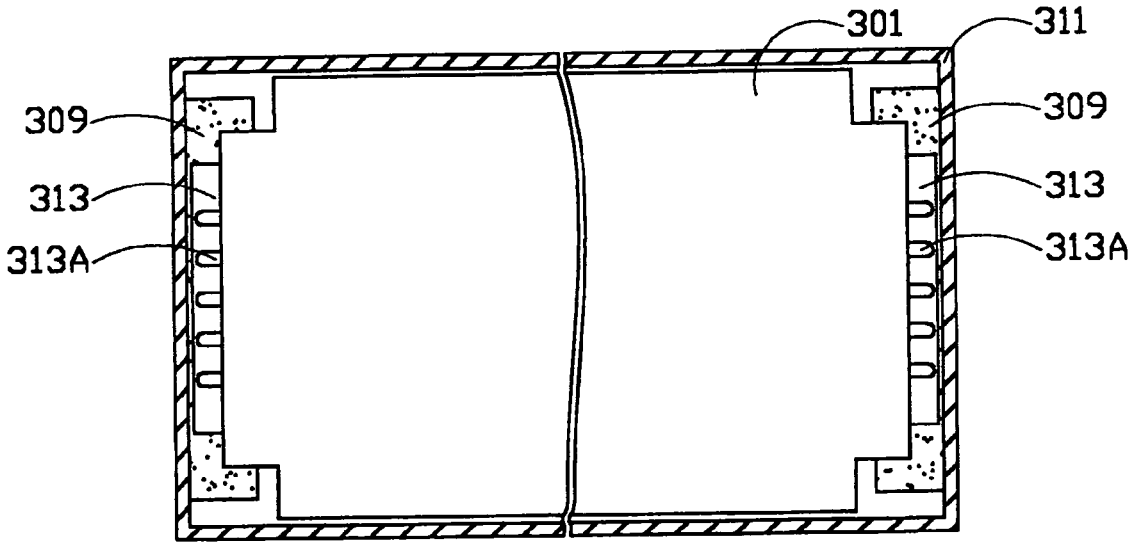

In the first embodiment of the present invention, the cooling unit 209 is disposed between the frames 203 and 205, and the light source 201. But referring to FIG. 3A, in the second embodiment of the present invention, A light source 301 and other optical elements (not shown) such as a diffusing plate, a reflecting plate, and a polarizing plate are assembled within the case 311 of the LCD device 30. The upper frame 303 is disposed over the light source 301 and the lower frame 305 is disposed under the light source 301. The cooling unit 309 is disposed among the upper frame 303, the lower frame 305, and the light source 301. A power supply device 313 supplies electric power to the light source 301. FIG. 3B is a sectional view of a fastening device of this embodiment along line 3B–3B' of FIG. 3A. It's observed that plurality of power plugs 313A of the power supply device 313 provide electric connection for the electrodes (not shown) of the light source 301.

Figure 3C:
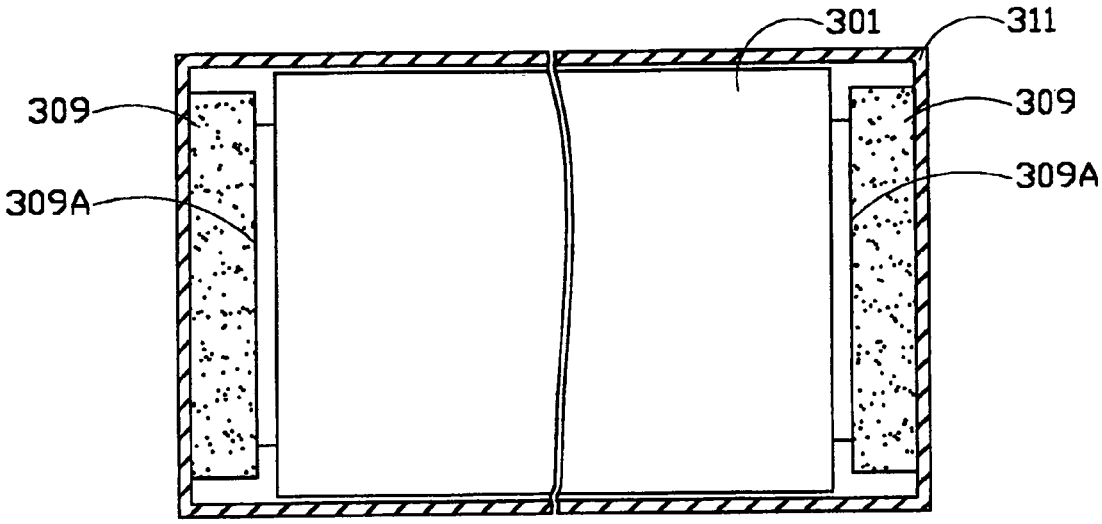

In this embodiment, the cooling unit 309 has a reflecting surface 309A to increase the lighting efficiency. Simultaneously referring to FIG. 3C, a sectional view of a fastening device of this embodiment along line 3C–3C' of FIG. 3A. The reflecting surface 309A of the cooling unit 309 is arranged facing toward the light source 301 to reflecting the emitting light.

Figure 3D:
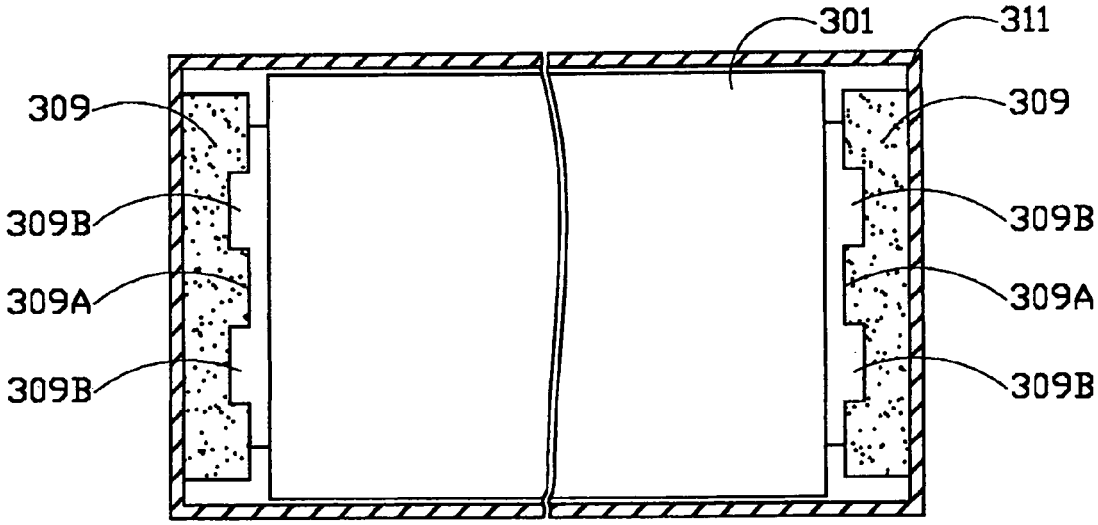
FIG. 3D and FIG. 3E illustrate the profile variations of the cooling unit according to the present invention.
Figure 3E:
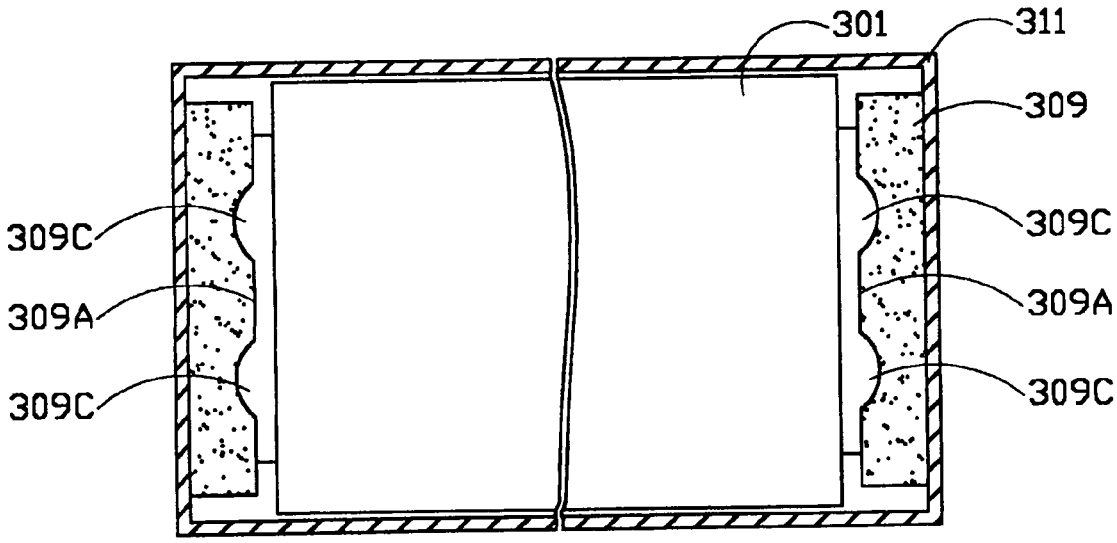

In above first and second embodiments of the present invention, the profile of the reflecting surfaces 209A and 309A is flat. But for increasing the cooling space, a plurality of notched structures could be formed on the portion of the reflecting surface according to present invention. Referring to FIGS. 3D and 3E, a plurality of rectangular notches 309B and arc notches 309C are formed on the reflecting surface 309A, and the opening of the rectangular and arc notches 309B and 309C are arranged facing toward the light source 301. Furthermore, the notched structures of the cooling unit are also still provided with a reflecting surface by coating the reflecting material. Hence, the number and profile of the notched structures will not be limited by the above embodiments. The heat produced from the light source will radiate by the help of the cooling unit with its notched structure.

The fastening device, provided by the present invention, is utilized for cooling the light source and preventing dust from dropping in the cooling space of the fastening device. The cooling unit disposed adjacent to the light source not only cools the light source but also prevents the oscillation that affects the emitting efficiency of the light source and the operating stability of operating the light source.

Obviously, many modifications and variations of the present invention are possible in light of the above teachings. It is to be understood that within the scope of the appended claims, the present invention may be practiced other than as specifically described herein.

Although the specific embodiments have been illustrated and described, it will be obvious to those skilled in the art that various modifications may be made without departing from what is intended to be limited solely by the appended claims.

What is claimed is:

1. A fastening device, comprising:

a frame adapted to be disposed adjacent to a light source; and a cooling unit disposed between said frame and the light source to clip the edge of the light source, wherein said cooling unit has a reflecting surface substantially toward the light source and said cooling unit touches both of said frame and said light source.

2. A fastening device, comprising:

a frame adapted to be disposed adjacent to a light source; and a cooling unit disposed between said frame and the light source, wherein said cooling unit has a reflecting surface substantially toward the light source and said cooling unit has a thermal conductivity coefficient of higher than about 1.0 W/mK.

3. The fastening device according to claim 1, wherein said cooling unit has a plurality of notches formed thereon.

4. A fastening device, comprising:

an upper frame adapted to be disposed over a light source;

a lower frame disposed under the light source; and a cooling unit disposed among the upper frame, the lower frame and the light source to clip the edge of the light source, wherein the cooling unit has a reflecting surface substantially toward the light source and said cooling unit touches both of at least one of said frames and said light source.

5. A fastening device, comprising:

a frame adapted to be disposed adjacent to a light source; and a cooling unit disposed between said frame and the light source to clip the edge of the light source, wherein said cooling unit has a plurality of notches formed thereon and said cooling unit touches both of said frame and said light source.

* * * * *